US012768162B2

(12) United States Patent
Owens et al.

(10) Patent No.: US 12,768,162 B2
(45) Date of Patent: Oct. 20, 2026

(54) EXPANSION JOINT WITH COVER PLATE

(71) Applicant: MM SYSTEMS, CORP., Pendergrass, GA (US)

(72) Inventors: Bryan O. Owens, Pendergrass, GA (US); Charles E. Lamb, Pendergrass, GA (US); Mark R. McDaniel, Pendergrass, GA (US)

(73) Assignee: MM SYSTEMS OPCO, LLC, Pendergrass, GA (US)

( * ) Notice: Subject to any disclaimer, the term of this patent is extended or adjusted under 35 U.S.C. 154(b) by 165 days.

(21) Appl. No.: 18/526,143

(22) Filed: Dec. 1, 2023

(65) Prior Publication Data

US 2024/0183149 A1 Jun. 6, 2024

Related U.S. Application Data

(60) Provisional application No. 63/385,848, filed on Dec. 2, 2022.

(51) Int. Cl.
*E04B 1/68* (2006.01)
*E04B 1/00* (2006.01)

(52) U.S. Cl.
CPC ..... *E04B 1/6803* (2013.01)

(58) Field of Classification Search
CPC ..... E04B 1/6803; E04B 1/681; E04B 1/6815; E04B 1/6809
See application file for complete search history.

(56) References Cited

U.S. PATENT DOCUMENTS 646,192 A * 3/1900 Purdy ..... E04B 2/56 52/778
2,018,334 A * 10/1935 Hagan ..... E04B 1/76 52/355
2,035,476 A * 3/1936 Herwood ..... E04B 1/681 404/51
2,078,620 A * 4/1937 Venzie ..... E04B 2/7854 52/354
2,280,142 A * 4/1942 Daniels ..... E04B 2/96 52/476
2,307,293 A * 1/1943 Paul ..... E04B 1/68 52/600
2,403,580 A * 7/1946 Cartwright ..... E04B 2/58 52/468
2,764,788 A * 10/1956 Macormack ..... E04B 1/6809 49/495.1
2,779,979 A * 2/1957 Sundelin ..... E04F 13/0889 52/489.2

(Continued)

FOREIGN PATENT DOCUMENTS

GB 2127878 A * 4/1984 ..... E04B 2/96
JP H061520 U * 1/1994
JP 2000001917 A * 1/2000

*Primary Examiner* — Brian D Mattei
*Assistant Examiner* — Joseph J. Sadlon
(74) *Attorney, Agent, or Firm* — Lambert Shortell & Connaughton; David J. Connaughton, Jr.; Justin P. Tinger

(57) ABSTRACT

An expansion joint system is provided which uses magnets to hold a cover plate to a base frame of a substrate. The expansion joint system allows the magnets to slide over the base frame/cover plate during normal movements of the substrates without applying tension to the cover plate. In a seismic or other disruptive event, the cover plate is tethered to the building via a bungee.

13 Claims, 11 Drawing Sheets

(56) References Cited

U.S. PATENT DOCUMENTS 3,057,444 A * 10/1962 Walberg ..... E04B 2/96 52/459
3,170,268 A * 2/1965 Balzer ..... E04B 1/6815 52/396.04
3,300,913 A * 1/1967 Patry ..... E04B 1/6809 52/396.04
3,439,463 A * 4/1969 Matarese ..... E04B 1/6803 52/287.1
3,448,552 A * 6/1969 Schmitt ..... E04B 1/6815 52/395
3,474,589 A * 10/1969 Cheatwood ..... E04B 1/681 52/471
3,609,934 A * 10/1971 O'Carroll ..... E04F 13/0883 52/461
3,864,886 A * 2/1975 Thom ..... E04B 1/6804 52/396.04
4,227,360 A * 10/1980 Balinski ..... E04B 2/7409 52/243
4,452,029 A * 6/1984 Sukolics ..... E04B 1/617 52/510
4,517,779 A * 5/1985 Dunsworth ..... E04B 1/6804 52/396.04
4,611,449 A * 9/1986 Wilson ..... E04B 1/6815 52/396.04
4,649,129 A * 3/1987 Dunsworth ..... E04B 1/68 502/407
4,866,896 A * 9/1989 Shreiner ..... E04F 13/0736 52/235
4,932,183 A * 6/1990 Coulston ..... E04B 1/6815 52/417
5,078,529 A * 1/1992 Moulton ..... E04B 1/6804 403/388
5,083,405 A * 1/1992 Miller ..... E04B 1/7612 52/235
5,239,798 A * 8/1993 Saito ..... E04C 2/384 52/235
5,259,162 A * 11/1993 Nicholas ..... E04B 1/681 52/468
5,357,727 A * 10/1994 Duckworth ..... E04B 1/681 52/573.1
5,365,713 A * 11/1994 Nicholas ..... E04B 1/681 52/573.1
5,381,637 A * 1/1995 Farag ..... E06B 3/5427 52/204.593
5,481,839 A * 1/1996 Lang ..... E04B 2/967 52/489.1
5,666,775 A * 9/1997 Shreiner ..... E04B 1/6803 52/573.1
5,829,216 A * 11/1998 Newcomb ..... E04F 13/0807 52/396.04
5,887,400 A * 3/1999 Bratek ..... E04B 1/681 52/573.1
6,014,848 A * 1/2000 Hilburn, Jr. ..... E01D 19/065 52/396.04
6,213,679 B1 * 4/2001 Frobosilo ..... E04B 2/96 403/14
6,430,884 B1 8/2002 Shreiner et al.
6,484,462 B2 11/2002 Shreiner et al.
6,993,873 B2 * 2/2006 Biebuyck ..... E04B 2/96 52/844
7,017,312 B1 * 3/2006 Mueller ..... E04B 1/2604 411/536
7,867,591 B2 * 1/2011 Sieber ..... E06B 1/62 428/40.1
8,371,419 B2 * 2/2013 Nonogi ..... B32B 27/306 181/290
8,511,025 B2 * 8/2013 Kawai ..... E04H 9/0237 52/393
9,145,906 B2 * 9/2015 Schuit ..... F16B 7/0446
9,181,692 B1 * 11/2015 Callaway ..... E04F 19/024
9,279,248 B2 * 3/2016 Bradford ..... E04B 1/6803
9,506,252 B2 * 11/2016 Molteni ..... A47B 96/067
9,523,197 B2 * 12/2016 Sessler ..... E04B 1/8409
9,661,940 B2 * 5/2017 Schneider ..... E06B 7/16
9,834,924 B2 * 12/2017 Lopez ..... E04B 2/828
9,951,514 B2 * 4/2018 Debuff ..... E04F 19/00
10,113,768 B2 * 10/2018 Carlyon ..... B32B 3/28
10,161,155 B2 * 12/2018 Lopez ..... E04B 2/74
10,260,274 B1 * 4/2019 Luvison ..... E06B 1/6007
10,316,516 B2 * 6/2019 Carlyon ..... E04C 2/292
10,443,234 B2 * 10/2019 Stronks ..... E04B 2/965
10,472,818 B2 * 11/2019 Ishida ..... E04B 1/3448
10,676,919 B2 * 6/2020 Yamazoe ..... G10K 11/172
10,787,817 B1 * 9/2020 Bilge ..... E04F 13/12
10,851,559 B2 * 12/2020 Almazán Campillay ..... E02D 5/74
10,858,826 B2 * 12/2020 Gebhardt ..... E04B 1/388
10,935,138 B2 * 3/2021 Fina Segura ..... E04B 1/681
11,098,475 B2 * 8/2021 Collins ..... E04B 1/2403
11,542,702 B2 * 1/2023 Krause ..... E04B 1/36
11,898,344 B2 * 2/2024 Gebhardt ..... E04B 1/61
12,024,876 B2 * 7/2024 Krause ..... E04B 1/388
12,209,406 B2 * 1/2025 Delcuve ..... E04C 2/292
12,590,454 B2 * 3/2026 Ness ..... E02D 29/045
2002/0164447 A1 * 11/2002 Asgian ..... E04B 1/66 428/40.1
2005/0210817 A1 * 9/2005 Carrier ..... F16B 5/0692 52/698
2005/0257451 A1 * 11/2005 Pryor ..... E04B 1/98 52/167.4
2006/0075705 A1 * 4/2006 Bradford ..... E01D 19/062 52/393
2009/0229208 A1 * 9/2009 Spannbauer ..... E04B 2/90 52/393
2014/0083036 A1 * 3/2014 Bazzarini ..... F21V 33/006 52/741.1
2015/0259901 A1 * 9/2015 Bradford ..... E04B 1/6803 52/167.1
2015/0284951 A1 * 10/2015 Frederick ..... E04B 2/90 52/235
2018/0282996 A1 * 10/2018 Titus ..... E04B 1/388
2019/0093339 A1 * 3/2019 Anraku ..... E04B 1/6803
2021/0047829 A1 * 2/2021 Anderson ..... E04B 1/388
2023/0250626 A1 * 8/2023 Krause ..... E04F 13/081 52/393

* cited by examiner

Section A-A

EXPANSION JOINT WITH COVER PLATE

BACKGROUND OF THE INVENTION

Expansion joints are necessary features of many buildings and are required in many building specifications and building codes. Put very simply, expansion joints allow for movement of building components due to thermal, seismic, and other movements. By allowing the building to move, expansion joints protect the building as a whole by limiting stresses applied to building materials.

However, many architects and designers do not like certain appearances of expansion joints. Typically, an expansion joint is covered by a metal cover plate. This cover plate must be anchored to the joint to hold it in place, and often this anchoring is done with screws. Industry feedback has shown that visible screws on the cover plate are undesirable and negatively impact the overall appearance of the building, whether on the interior or exterior.

One solution has been to connect the cover plate to the substrate or base frame using hook and loop fastener such as Velcro®. This may adequately hold the cover plate in place during stationary times. However, during thermal cycling, the hook and loop fastener does not allow any lateral movement of the substrates relative to the cover plate, applying strain on the connection and causing deformation of the cover plate. Further, in a seismic event with substantial movement of the substrates relative to one another, the hook and loop fastener system suffers a complete failure requiring full replacement and often repair of the substrates which are damage by the failure.

Therefore, what is needed is an expansion joint system which allows the cover plate to be held in place covering the joint without the use of visible external screws.

SUMMARY OF THE INVENTION

The subject matter of this application may involve, in some cases, interrelated products, alternative solutions to a particular problem, and/or a plurality of different uses of a single system or article.

In one aspect, an expansion joint system is provided. The expansion joint has a cover plate which is magnetically connectable across a gap to a base frame on opposing substrates. One or more magnets are connected to the cover plate. The magnets are selected to provide a secure connection between the cover plate and the base frame, and allow for sliding movement across the surface of the base frame to accommodate small movements of the substrates without applying strain to the cover plate. The cover plate is formed with a bent return shape at each lengthwise end, the bent return shape forming a channel along each lengthwise side of the cover plate. One or more stiffening bars are positioned along the length of the cover plate, the stiffening bars are connected to the cover plate by being held in place within the channel.

In another aspect, an expansion joint system is provided. The expansion joint has a cover plate that is magnetically connectable to a base frame on opposing substrates. One or more magnets are connected to the cover plate. The magnets are selected to provide a secure connection between the cover plate and the base frame, and allow for sliding movement across the surface of the base frame to accommodate small movements of the substrates without applying strain to the cover plate. The cover plate further has at least two lifting ramps connected to a rear face of the cover plate. These lifting ramps are angled towards the substrates to allow the cover plate to be urged away from the opposing substrates and away from the gap between the two substrates in response to movement of the substrates contacting one or both of the two lifting ramps. The lifting ramps are operable to prevent damage to the joint and substrates during seismic events or other conditions.

In yet another aspect, an expansion joint system is provided. The expansion joint system has a bracket attachable to a first building substrate, along with a cover plate which is magnetically connectable to the bracket. In many embodiments, the cover plate may have an upward bend at a proximal end, and a downward bend at a distal end near the magnetic connection to the bracket. A magnet is positioned on one or both of the bracket and cover plate. When magnetically connected, the connection between the bracket and cover plate is operable to resist lifting forces applied by wind. In the event of sufficient wind, the cover plate is able to lift away from the bracket against the force of the magnet to prevent warping and damage to the cover plate. A spring urges the cover plate back downward into magnetic engagement with the bracket. The spring is engaged with the proximal end of the cover plate and engaged with a second building substrate. As noted, the spring urges the distal end of the cover plate in a downward direction towards the first building substrate.

DETAILED DESCRIPTION OF THE INVENTION

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns an expansion joint system which has a cover plate held to the expansion joint using one or more magnets. As seen in the figures, the expansion joint involves opposing substrates with a base frame of the expansion joint connected to each of the substrates. A cover plate is magnetically connectable to the base frame and operates to cover the expansion joint. Typically, the cover plate expands past the edges of the substrates to allow it to continue to cover the joint when in an expanded or contracted position. Of course, in some large-movement conditions, the cover plate may be dislodged and is designed to do so. This magnetic connection may be achieved in any number of ways without straying from the scope of this invention. Importantly, magnetic connection of the cover plate to the base frame allows for a sliding movement across the surface of magnetic connection, allowing for small movements of the substrate without applying strain to the cover plate. The magnetic connection may be in the form of a magnet connected directly or indirectly to the cover plate, a magnet connected to the base frame, or magnets on both base frame and cover plate. In typical embodiments, the magnet may be connected to an aluminum cover plate and may be magnetically connected to the base frame, which is made of a magnetic metal, typically stainless steel. Though of course other embodiments and materials are well within the scope of this invention.

The magnets contemplated herein may be any type of magnet either currently know or to be discovered, and combinations thereof. Magnetic type and sizing is determined by the weight of the cover plate and selected to ensure secure connection of cover plate to the base frame.

Figure 1:
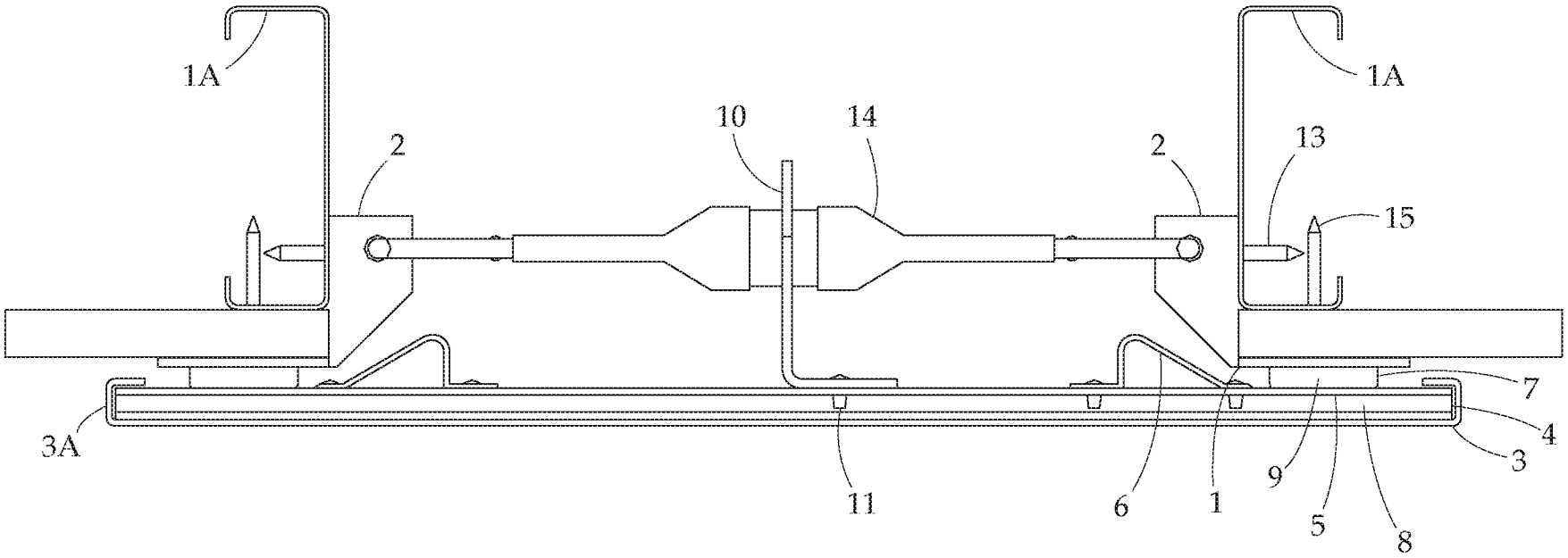
FIG. 1 provides a cross-sectional view of one embedment of the present disclosure.
Figure 2:
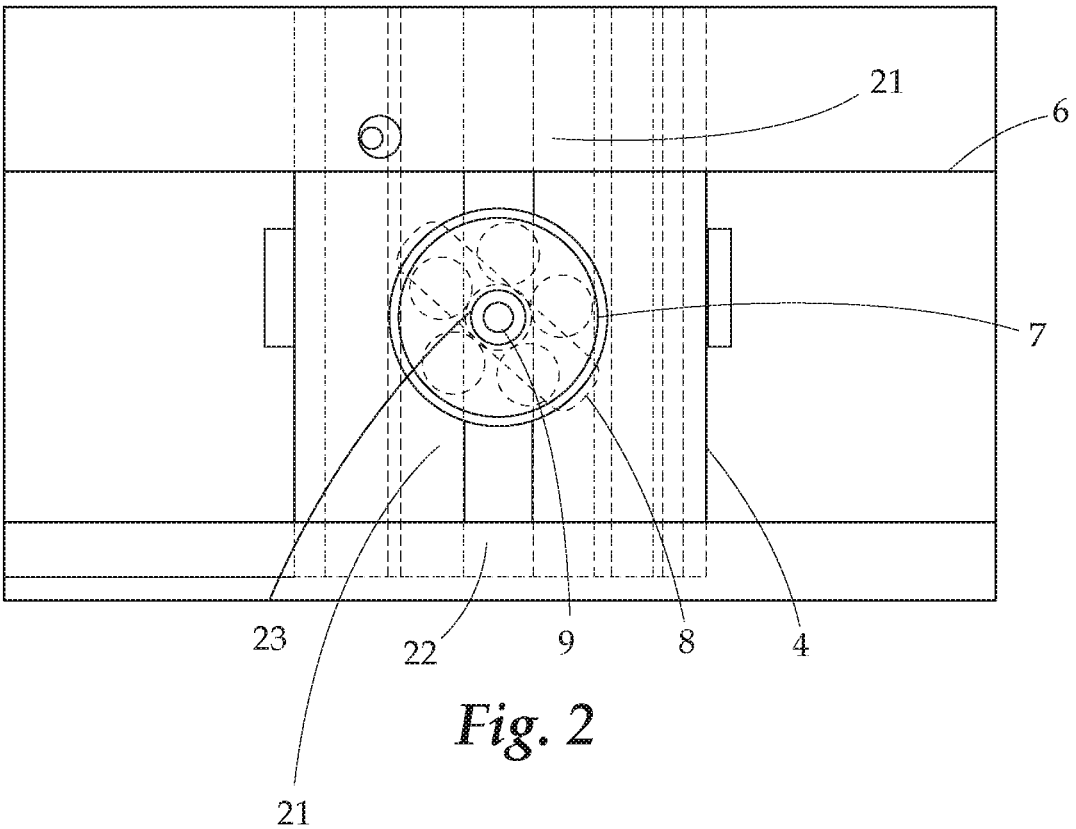
FIG. 2 provides a detail cross sectional view of another embodiment of this disclosure.
Figure 3:
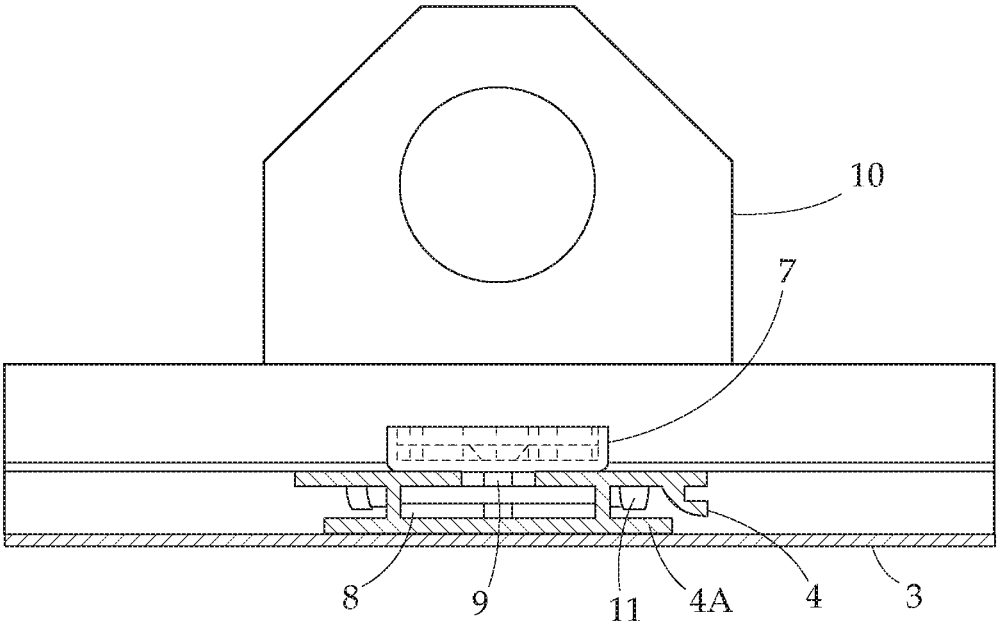
FIG. 3 provides a detail cross sectional view of yet another embodiment of this disclosure.
Figure 4:
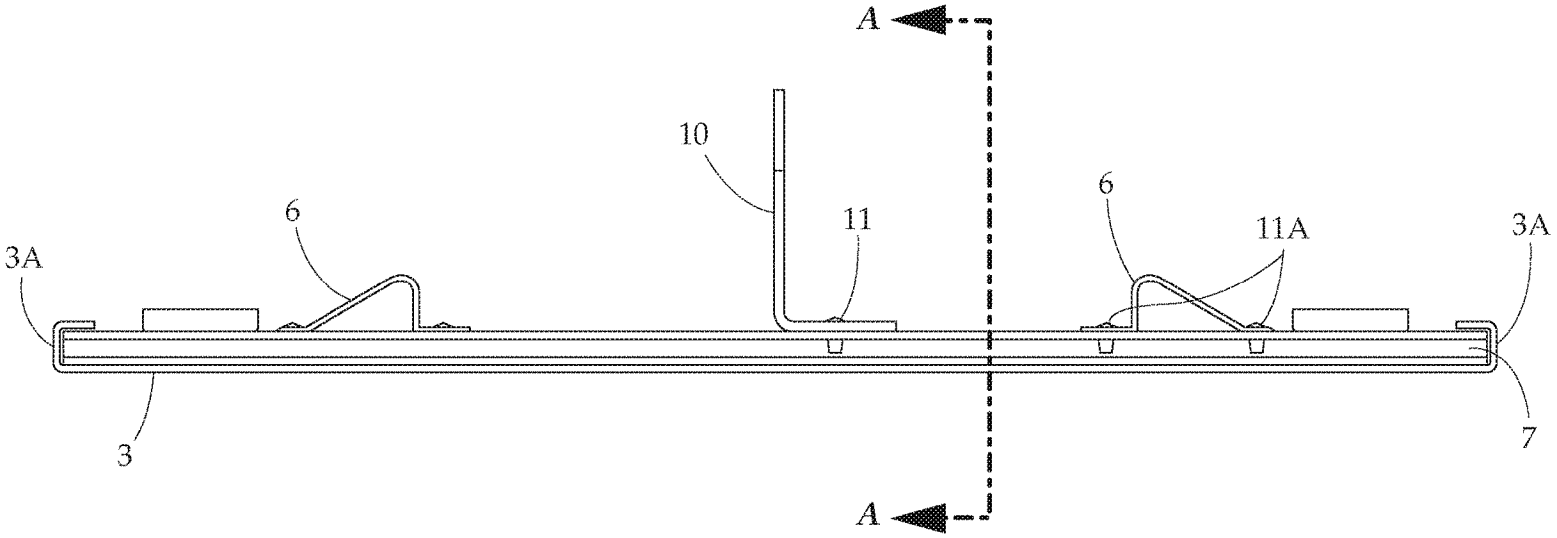
FIG. 4 provides a detail cutaway view of another embodiment of the present disclosure.
Figure 5:
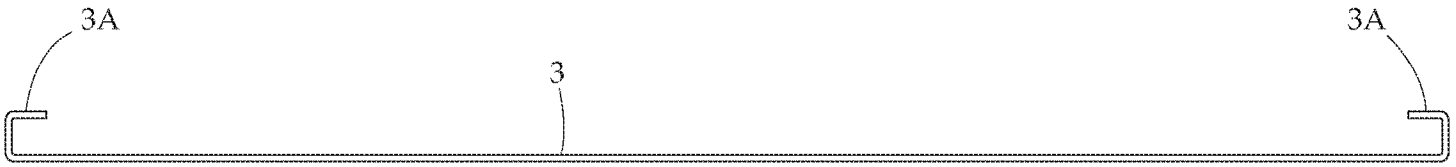
FIG. 5 provides a view of a cross section of a cover plate contemplated herein.
Figure 6:
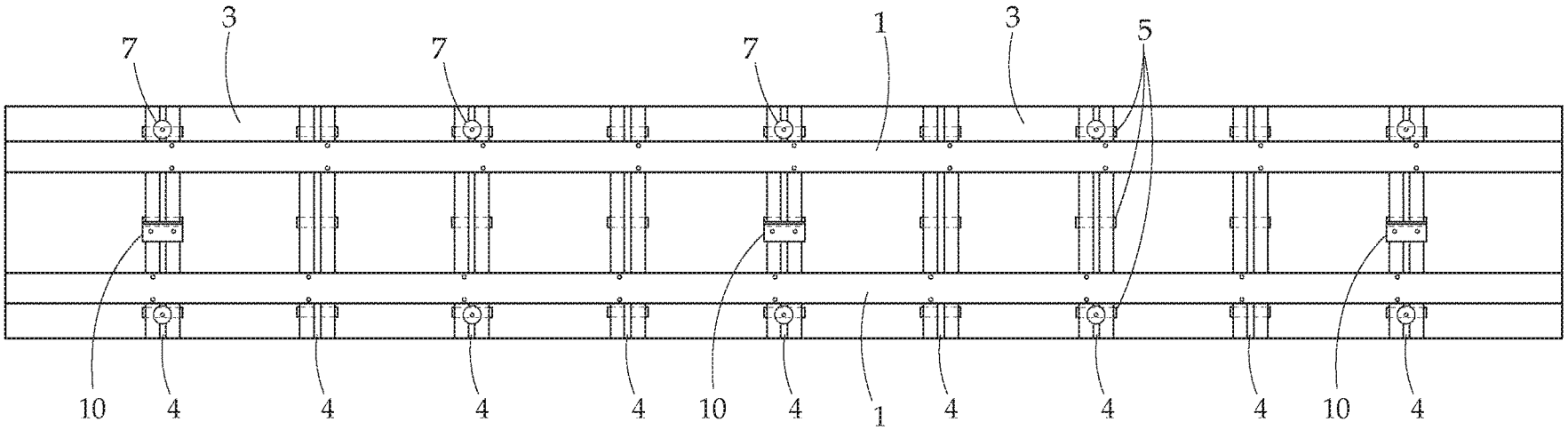
FIG. 6 provides a rear view of an embodiment of the present disclosure.
Figure 7:
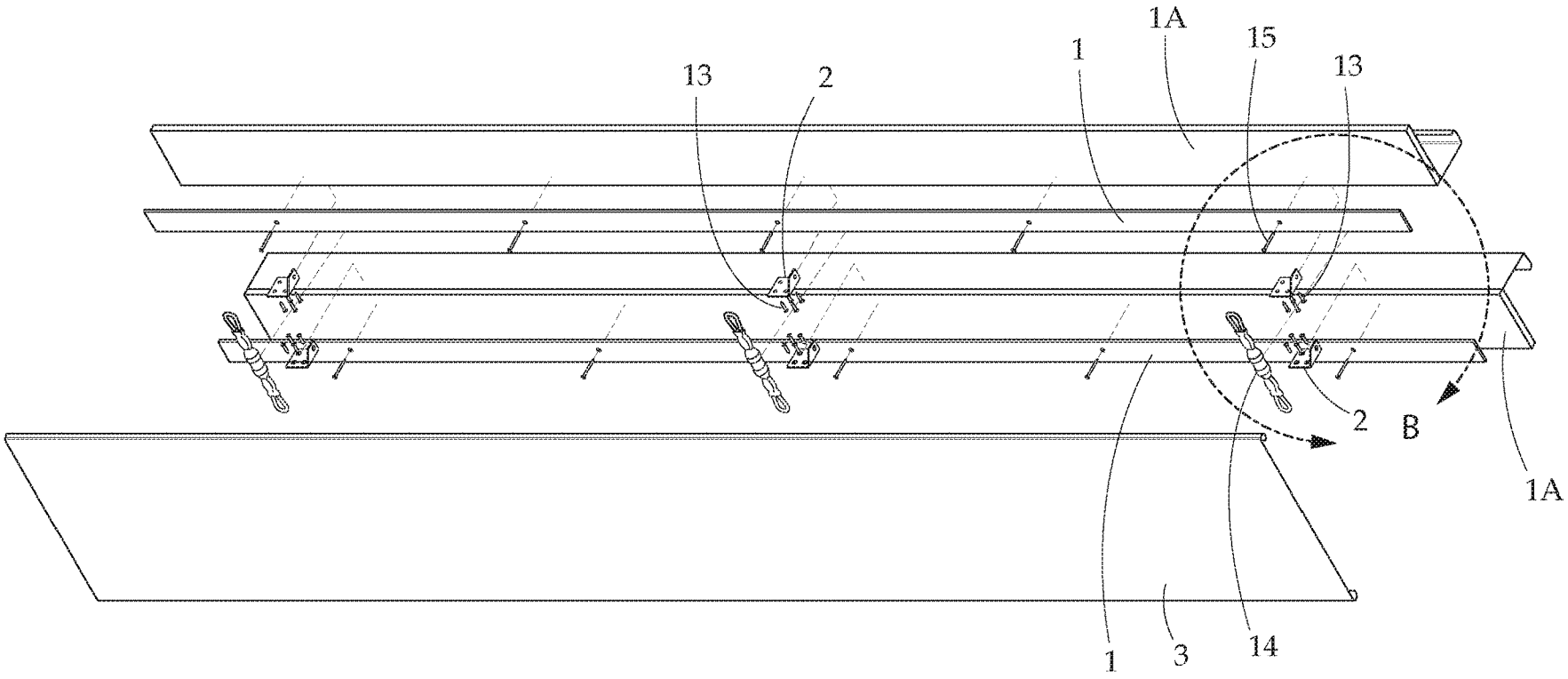
FIG. 7 provides a perspective exploded view of an embodiment of the present disclosure.
Figure 8:
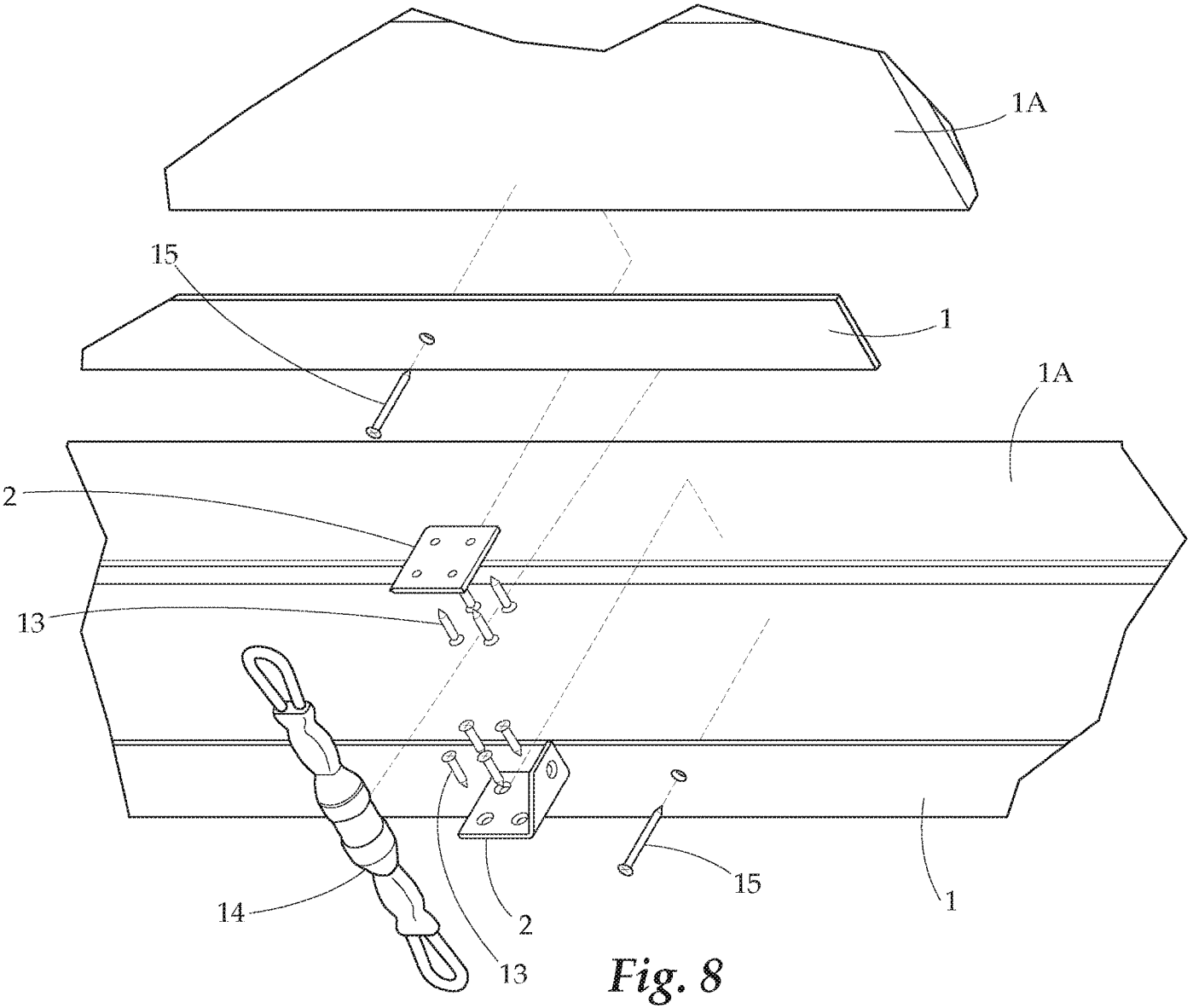
FIG. 8 provides a detail exploded view of one embodiment of the present disclosure.
Figure 9:
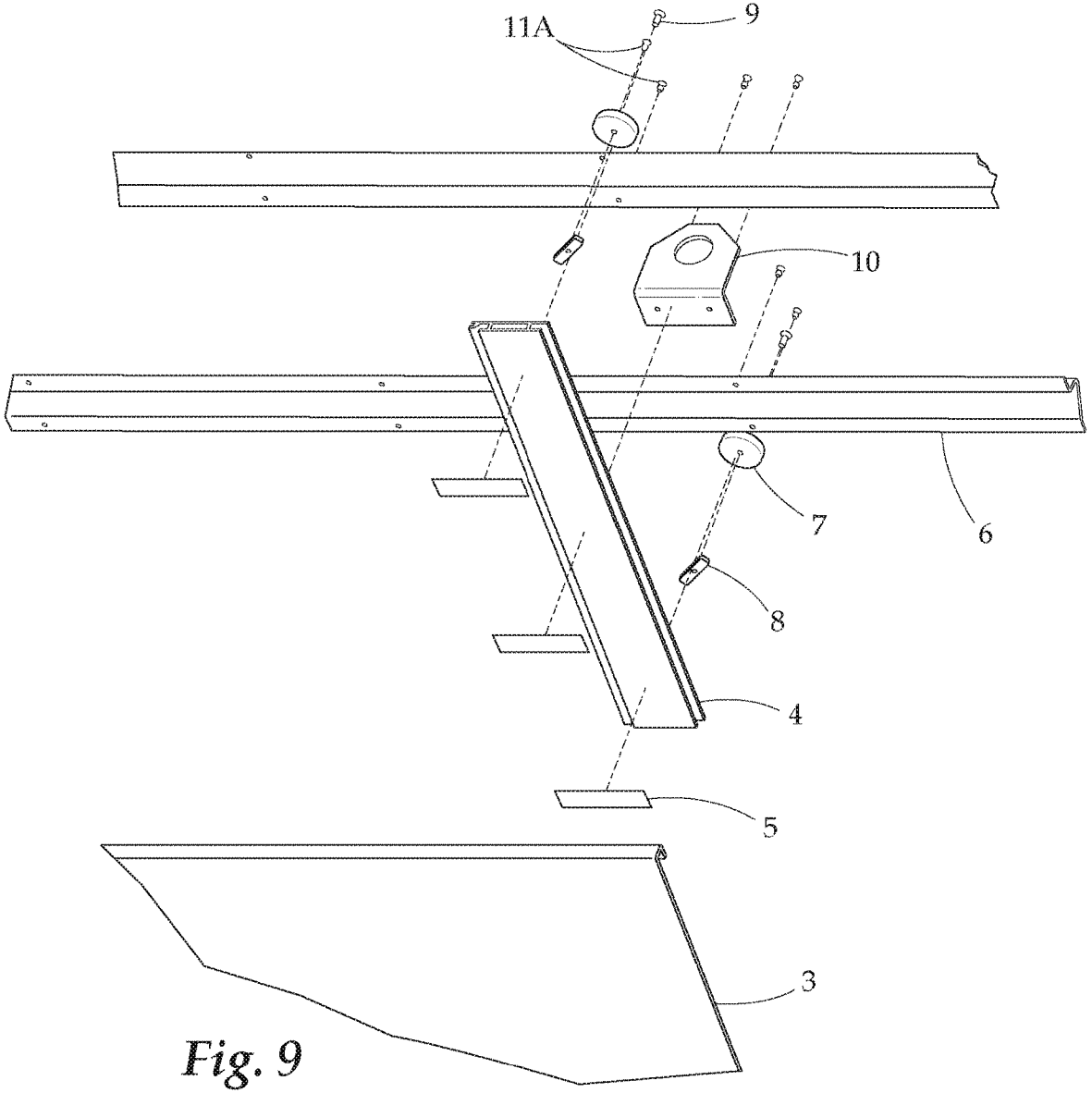
FIG. 9 detail exploded view of another embodiment of the present disclosure.

In a particular embodiment, as can be seen in FIGS. 1-9, the cover plate 3 has a bent return shape 3A at each lengthwise end, the bent return 3A forms a channel to which components may be connected. A stiffening bar 4 fits into the channel formed by the return 3A of the cover plate 3. The stiffening bar 4 may be held in place frictionally, with adhesive, and, in the embodiment shown, using a two-sided adhesive tape 5. As constructed, the stiffening bar or bars 4 along the length of the cover plate 3 help form a more rigid frame for the cover plate which can become flimsy overwide spans and lengths leading to poor performance and a non-uniform appearance. Further, the stiffening bars 4 provide structure to which the magnetic connection system can be connected with allowing connectors such as screws, bolts, and other mechanical connectors to engage without any components passing through the cover plate. In one embodiment, such as that shown in FIG. 3, the stiffening bar has a wide face 4A which abuts against the cover plate 3. This reduces overall pressure applied between the stiffening bar 4 and cover plate 3. Typically, a plurality of stiffening bars 4 are positioned along the length of the cover plate 3, such as, in the embodiment shown, every 24 inches. As noted, it is a goal of the present invention to avoid any visible connectors on the outside of the cover plate to provide a clean and unblemished continuous appearance of the cover plate of the expansion joint. The channel and stiffening bars, in this embodiment, are used to achieve this goal. In another embodiment, instead of (or in addition to) the bent return 3A forming a channel, an adhesive may be used to join the operational components such as magnets and lifting bars to a rear of the cover plate. The adhesive allows the connection of components without a visible appearance change on the front, visible side of the cover plate. In still another embodiment, a weld may be used to hold components in place, though in many cases the welding process may deform or discolor the cover plate, detracting from its outward appearance.

Two lifting ramps 6 are connected to the stiffening bar(s) 4 via connectors 11A such as rivets, screws, adhesive, welds, and the like. The lifting ramps 6 are angled pieces which extend along at least part of the length of the cover plate 3. The ramps 6 and are shaped such that if the substrate to which the cover plate 3 is connected is moved enough, it will push against the ramp to urge the cover plate away from the substrate, in turn disconnecting it from the magnetic connection holding the cover plate in place. Substrates contemplated herein may be any building piece which is designed to move under thermal, seismic, and other conditions. Typical substrates may be interior or exterior wall, ceiling, floor, and other materials. This may occur in, for example, seismic event where having the cover plate away from the expansion joint prevents damage to the joint and substrate. In a disconnected mode, in one embodiment the cover plate may be held loosely to the expansion joint by a bungee cord 14 which is connected to a bungee cord and safety cable mount 2 as well as a mount 10 which is connected to at least one of the stiffening bars 4. The bungee 14 is operable to gently ease the cover plate 3 away from the joint but prevent it from falling to the floor or elsewhere which could cause injury, block paths of egress, create tripping hazards, and the like. It is also important for the cover plate to come away from the substrates because the cover plate could fall or get wedged between the substrates and damage the substrates. In some embodiments, a backup cable may also be used as a secondary safety option in the event that the bungee 14 were to fail, the cover plate 3 would be prevented from falling.

In certain alternative embodiments, other structures may be used instead of a bungee cord. For example, a centering bar, known in the field, may be used instead of a bungee cord. The centering bar is operable to keep the cover plate centered relative to the movable substrates and base frame. In a further embodiment, the centering bar may be equipped with a magnet or magnetic metal at its center. The magnet or magnetic metal may be operable to engage with a magnet or magnetic metal on the cover plate, thereby holding the cover plate to the centering bar in addition to or instead of the base frame. In many embodiments, a plurality of centering bars are positioned along the length of the expansion joint, providing multiple places for connection of the cover plate to the centering bar(s). In another embodiment, a recoil mechanism may be used instead of a bungee cord. In yet another embodiment, one or more spring assemblies may be used instead of a bungee cord.

The expansion joint has a base frame 1 attached to the two opposing substrates 1A. The base frame 1 may be any material which is connected to two opposing substrates of the expansion joint. The base frame forms a part of the structure of the expansion joint and connects to the substrates to act as a base of the expansion joint. In the embodiment shown in the figures, the base frame 1 may be made of a metallic metal such as steel, stainless steel, and the like to allow a magnet positioned on the cover plate to connect to the base frame 1. In another embodiment, a magnet may be connected to the base frame 1 for connection to a portion of the cover plate and/or stiffening bars 4 which are made of a magnetic metal. In still another embodiment, a magnet may be connected to both base frame 1 and cover plate 3 and/or stiffening bars 4 such that a magnet-to-magnet connection may be made. In typical embodiments, the base frame 1 is joined to the substrate, and in the embodiment shown is joined by screws 13 and 15, with screws 13 holding the bungee cord and safety cable mount 2 to the frame 1 and substrate.

The magnet 7 may be joined to the stiffening bar 4 in any manner without straying from the scope of the invention. While connection of the magnet 7 directly to the cover plate 3 is a possibility, it has been found that generally a more pleasing appearance is achieved by connection to the stiffening bar 4 because there is no visible pass through connection joining the magnet to cover plate. Even a weld joining magnet to cover plate will result in discoloration and imperfections on the outer face of the cover plate 3. Adhesive connection of the magnet 7 to cover plate 3 is possible but less reliable and less secure than the preferred connection of magnet 7 to stiffening bar 4, which is in turn held to the cover plate 3 via the adhesive 5 and bent return channel formed by the cover plate.

In a particular embodiment, the magnet 7 is held to the stiffening bar 4 as follows. In this embodiment shown in the drawings the stiffening bar 4 has a back side which forms a channel 22 along its length. The channel 22 is formed by two inwardly extending flanges 21 which create a "T" shape. The magnet 7 shown in the figure is cylindrical with a hole passing through its center. Of course, any magnet shape and/or configuration may be used without straying from the scope of this invention. A bolt 9, passes through the hole in the magnet 7 and connects to a turn bar 8. The bolt head 11 can be manipulated to rotate the turn bar 8 such that it can be moved to a position parallel to the channel 22 in the stiffening bar 4 rear, and can then be rotated to engage with the flanges 21 forming the channel 22 at opposite sides of the channel 22. So engaged, the turn bar 8 will hold the magnet 7 in place to the stiffening bar 4. Of course, other connection arrangements to join the magnet to the stiffening bar are contemplated herein without straying from the scope of this invention.

The magnet may be, in many embodiments, fixed in position relative to the cover plate. However in other embodiments, it may be allowed to move somewhat to provide more flexibility in connection to the base frame. In a particular embodiment, the magnet may be located in a slot or channel which restrains the magnet but allows some side-to-side, up-down, and in-out movements. In a further embodiment, movement of the magnet may be dampened by, for example, springs, padding, fluid, and the like.

In various embodiments, the expansion joint and cover plate may be positioned so as to have the top of the cover plate flush with an adjacent wall, ceiling or floor. In other embodiments, the cover plate may extend away from the wall. In still further embodiments, the cover plate may be recessed from the adjacent wall or surface, and a panel of sheetrock, wall material, ceiling material, floor material, or other design element may be attached to the cover plate to match the adjacent wall or ceiling, or to create a flush design element, thereby forming the appearance of a flush wall and hiding the existence of the cover plate and expansion joint.

Importantly, expansion joints disclosed herein having a cover plate which is connected to the base frame via a magnet are easily repositioned after a seismic or other event which disconnects the cover plate from the joint. For example, after a seismic event, the cover plate will likely be dislodged due to a substrate urging against the lifting ramps and disconnecting the cover plate. An untrained maintenance worker may, without specific training or experience, reposition the cover plate by pushing it against the base frame. The nature of the magnetic connection is such that connection cannot be made if not properly positioned. This makes building recovery after a disruptive event much easier and less expensive than is currently available. Current solutions involve experienced and even licensed expansion joint installers to come and substantially repair and re-set the cover plates over the joints.

In still other embodiments, alternative fastening methods other than magnets may be used. For example, in one embodiment, high grade suction cups may be used to connect cover plate to base frame. In another embodiment, cable clips may be fastened to either cover plate or base frame and may snap into place on an opposing rod. Industrial quality snap buttons may be used in yet further embodiments to join cover plate to base frame.

In one embodiment, magnetic polarity may be used as an alternative to the lifting ramps of the cover plate assembly which cause the cover plate to be urged away by an inwardly-moving substrate. In such embodiments, opposing magnets having the same polarity may be positioned on both the base frame and cover plate. In a connected position, the like-poled magnets are offset and do not interact. However, in the event of a substantial movement of one or both of the substrates towards each other (reducing the joint gap), the magnets having like poles will align. This will cause the two magnets to oppose each other, and will urge the cover plate, to which one or more magnets is connected, away from the substrates and joint.

Additional figures are provided to show an embodiment of the magnetic cover plate applied to a roof joint system, which may also be applicable to any vertical-to-horizontal substrate joint. In many exterior roof expansion joints, particularly corner joints which join a lower roof to a vertical wall, forces applied by wind may cause a lifting force applied to the expansion joint cover plate. This can be particularly strong on corners which may experience swirling winds with a low-pressure area over the cover plate. In the prior art, the material strength of the cover plate and/or added stiffening bars at periodic lengths along the cover plate are used to prevent a bending or displacement of the cover plate. However, this can lead to over-engineered cover plates which are heavy and more expensive. Further, architects often find the appearance of the stiffening bars along the length of the cover plate to be undesirable from an appearance standpoint. Accordingly, the present disclosure also contemplates an exterior roof cover plate which uses magnets to hold the plate down against the forces applied by wind and other weather.

Figure 10:
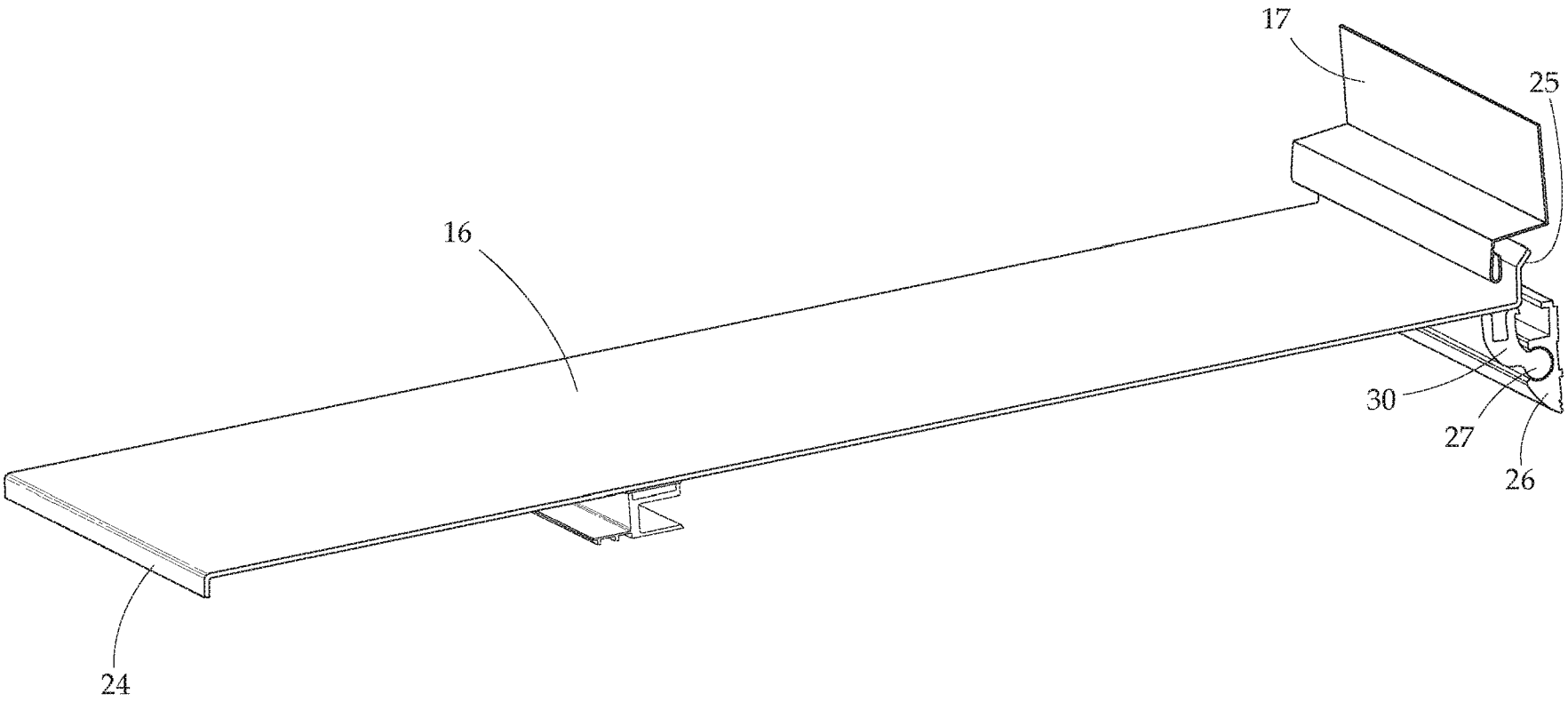
FIG. 10 provides yet still another embodiment of a cover plate system of the present disclosure.
Figure 11:
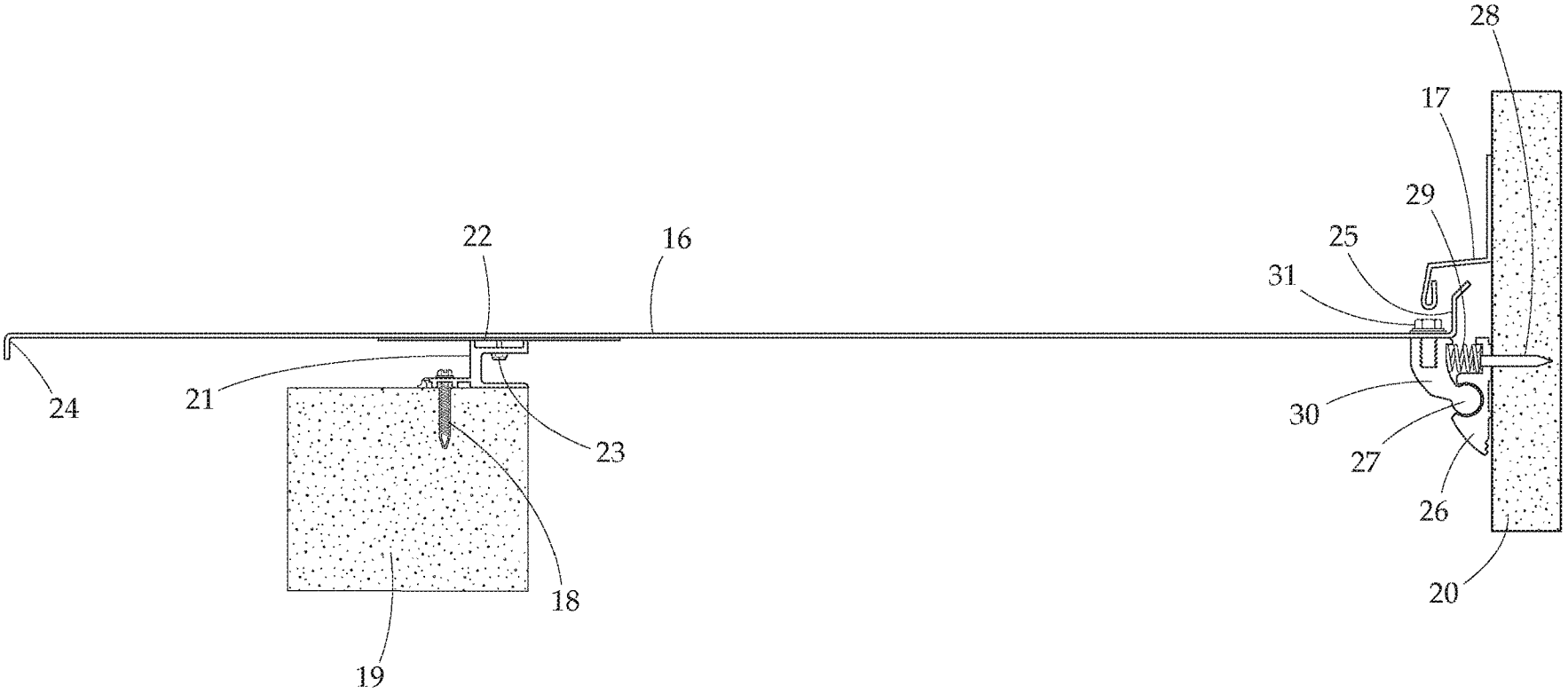
FIG. 11 provides a side cross-sectional view of the embodiment of FIG. 10.
Figure 12:
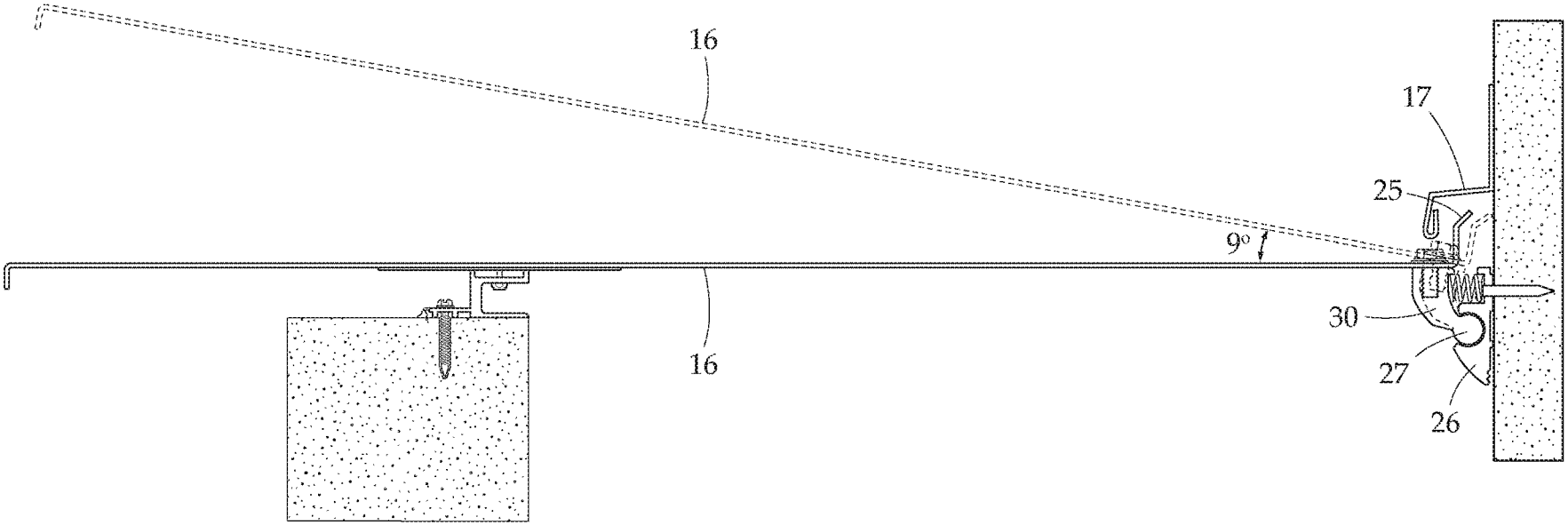
FIG. 12 provides a view of the range of motion provided by the cover plate system of the embodiment of FIG. 10.
Figure 13:
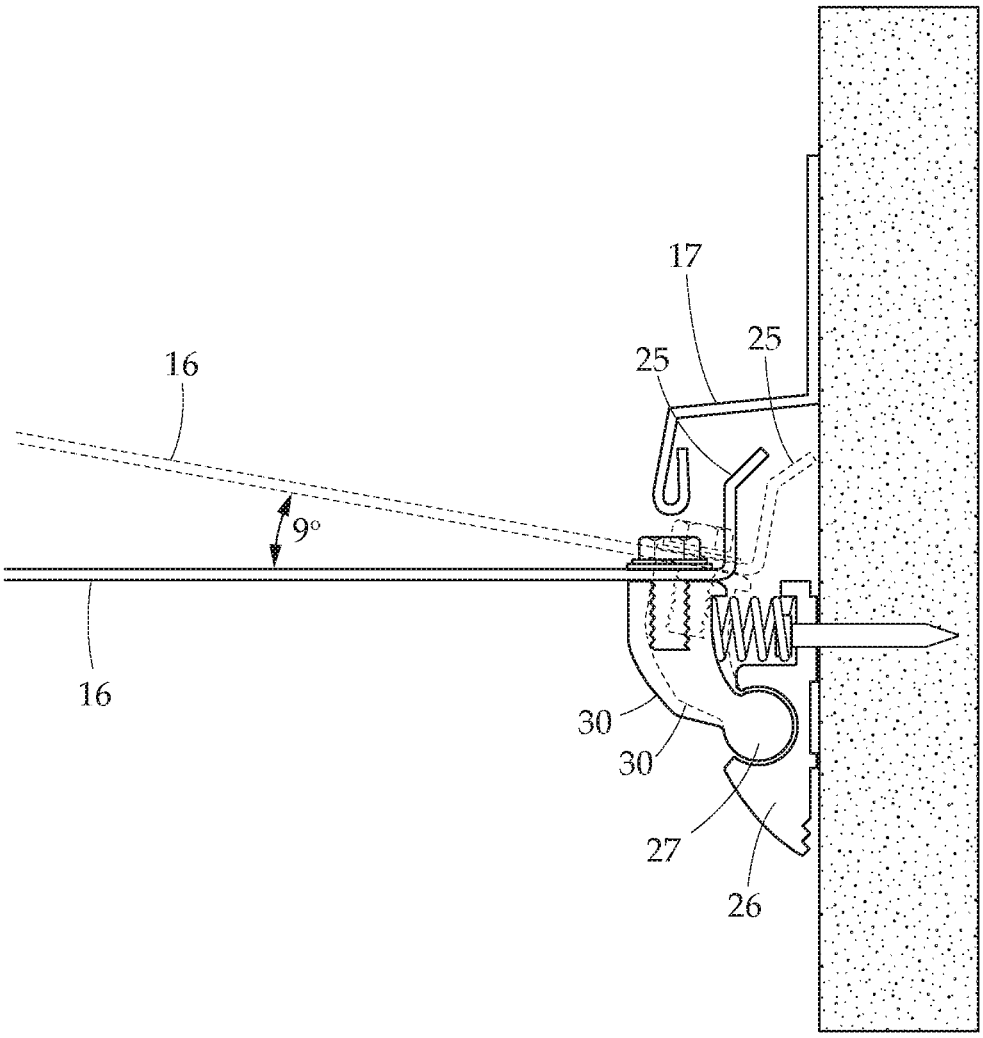
FIG. 13 provides a detail view of yet another embodiment of the present disclosure.

As seen in FIGS. 10-13, one embodiment of a wall to roof expansion joint system is shown having the cover plate magnetically held down against wind and weather forces. In many instances, even under high wind loads such as a big gust of wind, if the cover plate is lifted away from the magnet, separating the two, a spring and/or the material properties urge the cover plate downward to re-engage it with the magnet once conditions return to more normal operating conditions. In this view, an expansion joint is positioned between a wall 20 or other vertical substrate and a roof 19 or other flat surface substrate. A bracket 26, also referred to as a base frame connects to the wall via screw 28. The bracket 26 defines a ball joint 27 which allows pivoting motion of a body 30 relative to the wall 20. The cover plate 16 is joined to the body 30 via bolt 31. An upward bend 25 of the cover plate 16 combined with flashing 17 limits water and weather intrusion through the joint. Spring 29 is positioned between the body 30 and wall 20 and urges the distal end of the cover plate 16 in a downward direction towards the opposing roof 20 top. The distal end of the cover plate 16 has a down bend 24 for weather resistance and clean appearance. On the roof 19, the expansion joint has a bracket 21 also referred to as a base frame. The bracket 21 is joined to the roof 10 by a screw 18. Bracket 21 holds a magnet 22 which, in this embodiment, is joined to the bracket 21 by a bolt 23. The magnet 22 is operable to engage with the cover plate 16. This magnetic connecting engagement may be either by directly engaging with the cover plate 16 if the cover plate is made of a magnetic metal such as steel or certain stainless steel, or engaging with a strip or magnet attached to the bottom of the cover plate 16 if the cover plate is not made of a magnetic metal (such as if the cover plate is aluminum). The cover plate may be of any size, length, and width, without straying from the scope of this disclosure.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An expansion joint system comprising:

a cover plate magnetically connectable to a base frame on opposing substrates;

one or more magnets connected to the cover plate wherein the magnets are selected to provide a secure connection between the cover plate and the base frame, the magnets allowing for sliding movement across the surface of the base frame to accommodate small movements of the substrates without applying strain to the cover plate;

the cover plate having a bent return shape at each lengthwise end, the bent return shape forming a channel at each lengthwise end, the bent return being formed with a rearward extending portion at each lengthwise end of the cover plate, and an inwardly extending portion which extends toward a center of the cover plate, the channel defined by the rearward extending portion, the inwardly extending portion, and a rear of the cover plate;

one or more stiffening bars positioned along the length of the cover plate, the one or more stiffening bars extending across the cover plate and engaged with both channels, the one or more stiffening bars held in place within each channel.

2. The expansion joint system of claim 1 wherein the one or more magnets are each connected to the one or more stiffening bars.

3. The expansion joint system of claim 2 wherein the one or more stiffening bars each having a housing in which the one or more magnets are removably held.

4. The expansion joint system of claim 1, wherein the one or more stiffening bars are each held in place within the channel by friction, adhesive, or a two-sided adhesive tape.

5. The expansion joint system of claim 1, wherein the magnets are selected based a weight of the cover plate, to ensure a secure magnetic connection between the cover plate and the base frame.

6. The expansion joint system of claim 1 wherein the one or more stiffening bars are configured to allow connectors, including screws, bolts, and other mechanical connectors, to engage with the one or more stiffening bars without passing through a front side of the cover plate.

7. The expansion joint system of claim 1, further comprising two lifting ramps connected to the cover plate.

8. The expansion joint system of claim 7 wherein the two lifting ramps are connected to the one or more stiffening bars, the two lifting ramps being angled to allow the cover plate to be urged away from the opposing substrates in response to movement of the opposing substrates against one or both of the two lifting ramps.

9. The expansion joint system of claim 1, further comprising a bungee cord connected to the cover plate by a bracket.

10. The expansion joint system of claim 9 wherein the bracket is attached to at least one of the one or more stiffening bars.

11. An expansion joint system comprising:

a cover plate magnetically connectable to a base frame on opposing substrates;

one or more magnets connected to the cover plate wherein the magnets are selected to provide a secure connection between the cover plate and the base frame, the magnets allowing for sliding movement across the surface of the base frame to accommodate small movements of the substrates without applying strain to the cover plate;

wherein the cover plate comprises one or more stiffening bars extending across a width of the cover plate from one side to the other, each of the one or more stiffening bars engaged with the cover plate having one end of each of the one or more stiffening bars engaged with a channel on one edge of the cover plate, and a second end of each of the one or more stiffening bars engaged with a second channel on an opposite edge of the cover plate;

the cover plate comprising two lifting ramps mechanically connected to at least one of the one or more stiffening bars;

and the one or more magnets mechanically connected to each of the one or more stiffening bars.

12. The expansion joint system of claim 11, further comprising a bungee cord connected to the cover plate by a bracket.

13. The expansion joint system of claim 12 wherein the bracket is attached to at least one of the one or more stiffening bars.

* * * * *